US012220783B2

(12) United States Patent
Crashley

(10) Patent No.: US 12,220,783 B2
(45) Date of Patent: Feb. 11, 2025

(54) SHARPENING TOOL

(71) Applicant: Paula J. Crashley, New Tripoli, PA (US)

(72) Inventor: Paula J. Crashley, New Tripoli, PA (US)

( * ) Notice: Subject to any disclaimer, the term of this patent is extended or adjusted under 35 U.S.C. 154(b) by 469 days.

(21) Appl. No.: 17/704,628

(22) Filed: Mar. 25, 2022

(65) Prior Publication Data

US 2023/0302598 A1 Sep. 28, 2023

(51) Int. Cl.
*B24B 3/54* (2006.01)

(52) U.S. Cl.
CPC ..... *B24B 3/54* (2013.01)

(58) Field of Classification Search
CPC .. B24B 3/54; B24B 3/605; B24B 3/60; B24B 3/40; B24B 9/04; B24B 19/002; B24B 19/009; B24B 19/16; B24B 23/005; B24B 23/026; B24B 41/06; B24B 41/065; B24B 41/066; B24B 55/04; B24B 55/052
USPC ..... 451/555, 359
See application file for complete search history.

(56) References Cited

U.S. PATENT DOCUMENTS 2,578,309 A * 12/1951 Kroczek ..... B24B 3/605 451/278
3,812,626 A * 5/1974 Thompson ..... B24B 3/003 451/241
6,146,257 A * 11/2000 Himeno ..... B24B 3/605 76/82

* cited by examiner

*Primary Examiner* — Robert F Neibaur
(74) *Attorney, Agent, or Firm* — Sterne, Kessler, Goldstein & Fox P.L.L.C.

(57) ABSTRACT

Disclosed herein are apparatus and system embodiments that allow a user to sharpen instruments. An apparatus embodiment includes a body with a lower portion and an upper portion, one or more protrusions extending from the lower portion of the body and attached to the upper portion of the body, and a cap configured to be attached to the upper portion of the body. A system embodiment includes a sharpening accessory and a power source, where the sharpening accessory includes a body with a lower portion and an upper portion, one or more protrusions extending from the lower portion of the body and attached to the upper portion of the body, a removable cap configured to be attached to the upper portion of the body, and a sharpening device to be inserted into the body, where the power source is configured to rotate the sharpening device.

20 Claims, 5 Drawing Sheets

200

300

400

500
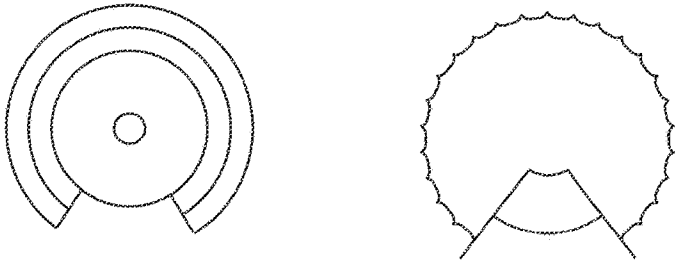
FIG. 5A
FIG. 5B
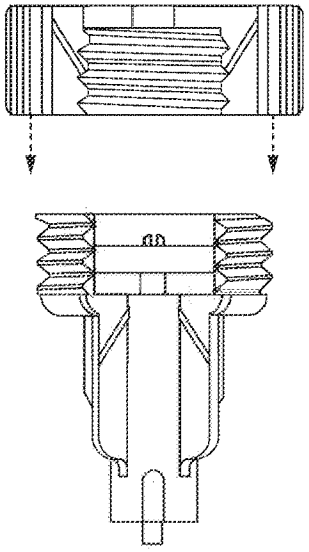
FIG. 5C
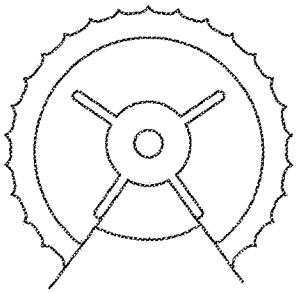
FIG. 5D
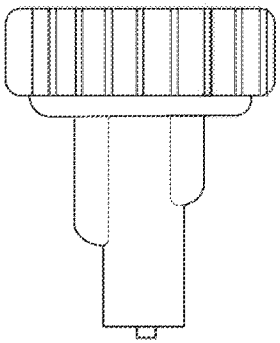
FIG. 5E

SHARPENING TOOL

BACKGROUND

Edges of cutting instruments need to be sharpened for optimal effectiveness. For example, cutting edges of a dental instrument (e.g., a dental scaler) can be sharpened to effectively perform dental procedures. A whetstone can be used to sharpen the cutting edges, but such use can be a time-consuming process.

SUMMARY

In embodiments presented herein, a sharpening tool is provided.

In an embodiment, an apparatus includes a body with a lower portion and an upper portion, one or more protrusions extending from the lower portion of the body and attached to the upper portion of the body, and a cap configured to be attached to the upper portion of the body.

In another embodiment, an apparatus includes a body with a lower portion and an upper portion, one or more protrusions extending from the lower portion of the body and attached to the upper portion of the body, a sharpening device to be inserted into the body, and a cap configured to be attached to the upper portion of the body.

In yet another embodiment, a system includes a sharpening accessory and a power source. The sharpening accessory includes a body with a lower portion and an upper portion, one or more protrusions extending from the lower portion of the body and attached to the upper portion of the body, a removable cap configured to be attached to the upper portion of the body, and a sharpening device to be inserted into the body. The power source is configured to rotate the sharpening device.

Further features and advantages, as well as the structure and operation of various embodiments, are described in detail below with reference to the accompanying drawings. It is noted that the specific embodiments described herein are not intended to be limiting. Such embodiments are presented herein for illustrative purposes only. Additional embodiments will be apparent to persons skilled in the relevant art(s) based on the teachings contained herein.

BRIEF DESCRIPTION OF THE DRAWINGS

The accompanying drawings, which are incorporated herein and form a part of the specification, illustrate embodiments of the present disclosure and, together with the description, further serve to explain the principles of the disclosure and to enable a person skilled in the pertinent art to make and use the disclosure.

FIGS. 5A-5E are illustrations of a sharpening accessory's body, sharpening device, and cap for a sharpening tool, according to some embodiments of the present disclosure.

In the drawings, like reference numbers generally indicate identical or similar elements. Additionally, generally, the left-most digit(s) of a reference number identifies the drawing in which the reference number first appears.

DETAILED DESCRIPTION

Figure 1:
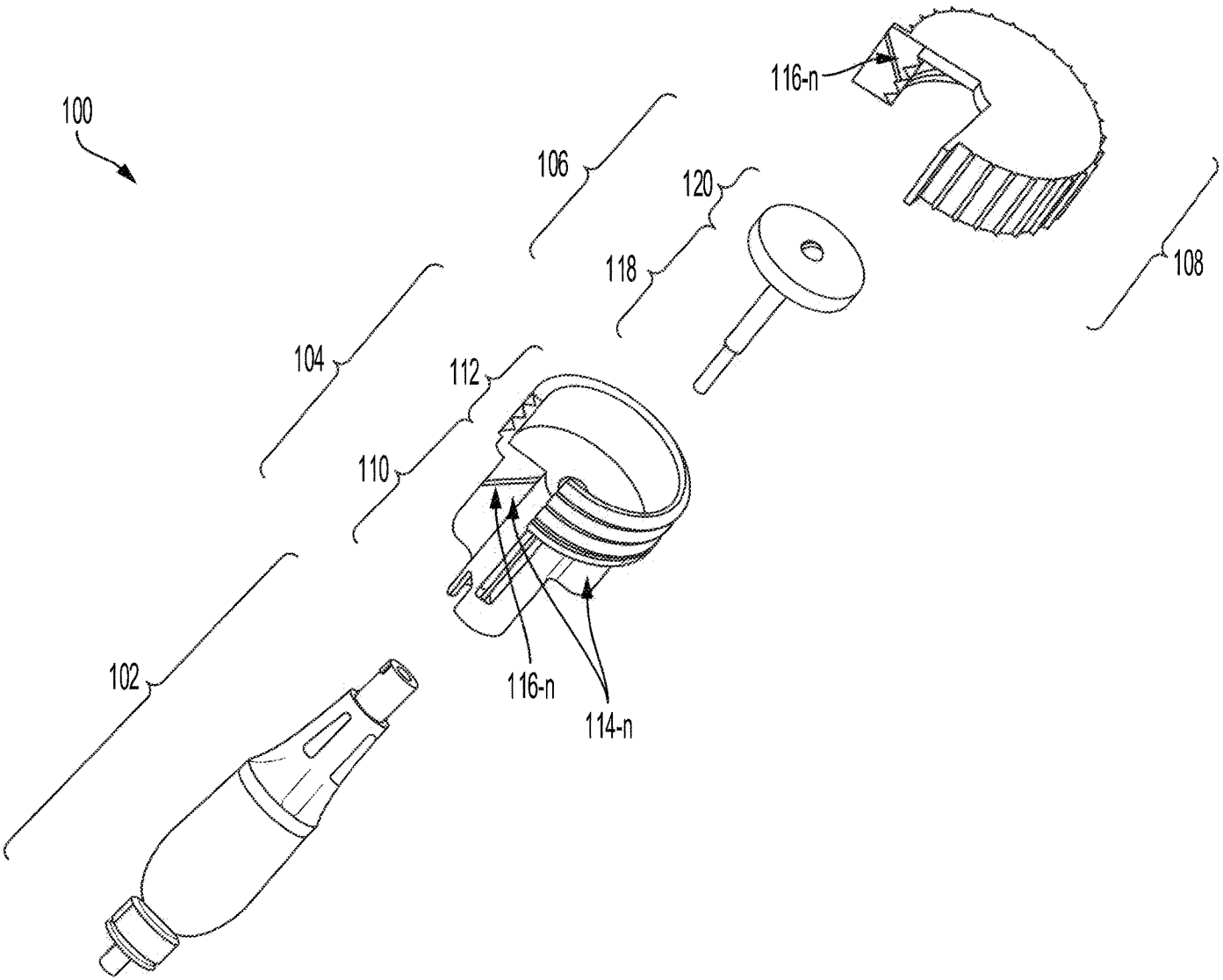
FIG. 1 is an illustration of a detached view of a power source and a sharpening accessory's body, sharpening device, and cap for a sharpening tool, according to some embodiments of the present disclosure.

Provided herein are apparatus and system embodiments, and combinations and sub-combinations thereof, for a sharpening tool.

Sharpening instruments do not achieve the level of efficiency, stability, and accuracy needed to properly sharpen cutting edges of certain instruments. Embodiments herein solve these technological problems, among others, with a sharpening tool that provides improved stability and control. For example, the sharpening tool can include a sharpening accessory and a power source. The power source can be configured to rotate a sharpening device within the sharpening accessory, in which a cap secures the sharpening device within the sharpening accessory, to provide a time-efficient mode of sharpening. In addition, one or more protrusions on a body of the sharpening accessory allows a user to securely grasp the sharpening accessory with their fingers, thus providing stability. The sharpening accessory can also include one or more guides to align an instrument at a predetermined angle for sharpening, thus providing accuracy.

The following embodiments are described in sufficient detail to enable those skilled in the art to make and use the disclosure. It is to be understood that other embodiments are evident based on the present disclosure, and that component, apparatus, or system changes can be made without departing from the scope of an embodiment of the present disclosure.

In the following description, numerous specific details are given to provide a thorough understanding of the disclosure. However, it will be apparent that the disclosure can be practiced without these specific details. To avoid obscuring embodiments of the present disclosure, some configurations are not disclosed in detail.

The drawings showing embodiments of the apparatus are semi-diagrammatic, and not to scale. Some of the dimensions are for the clarity of presentation and are shown exaggerated in the drawing figures. Similarly, although the views in the drawings are for ease of description and generally show similar orientations, this depiction in the figures is arbitrary for the most part. Generally, the disclosure can be operated in any orientation.

FIG. 1 is an illustration of a detached view of a power source 102 and a sharpening accessory for a sharpening tool 100, according to some embodiments of the present disclosure. The sharpening accessory can include a body 104, a sharpening device 106, and a cap 108. Body 104 can include a lower portion 110, an upper portion 112, one or more protrusions 114-*n*, and one or more guides 116-*n*. Sharpening device 106 can include a rod 118 and a top portion 120. Cap 108 can include one or more guides 116-*n*. FIG. 1 is described with reference to FIGS. 2A-2D, 3A, 3B, 4A-4D, and 5A-5E.

Referring to FIG. 1, power source 102 can generate a rotational force, according to some embodiments. Power source 102 can be pneumatic or electric. A pneumatic power source can use compressed air to generate the rotational force. A pneumatic power source can include an air compressor and an impeller. An electric power source can use electricity to generate the rotational force. An electric power source can include an electric motor.

Power source 102 can connect with lower portion 110 through a locking mechanism. In some embodiments, the locking mechanism can be compatible with a Borden coupler, a Midwest coupler, a 6-pin coupler, or any other suitable type of coupler.

Power source 102 can also connect with rod 118 through body 104, according to some embodiments. Power source 102 can connect with a first end of rod 118. Power source 102 can connect with rod 118 via a Borden coupler, a Midwest coupler, a 6-pin coupler, or any other suitable type of coupler. Power source 102 can rotate sharpening device 106 at various revolutions per minute (rpm). For example, power source 102 can rotate sharpening device 106 at less than or equal to 500,000 rpm.

Referring to FIG. 1, body 104 can be made from a metal, a plastic, a rubber, or a composite material. Body 104 can include lower portion 110, upper portion 112, one or more protrusions 114-*n*, and one or more guides 116-*n*.

Figure 2A:
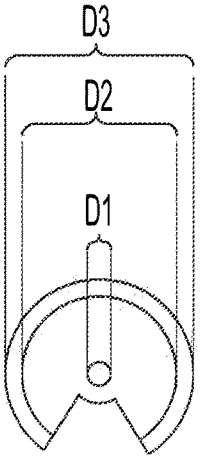
FIGS. 2A-2D are illustrations of a sharpening accessory's body for a sharpening tool, according to some embodiments of the present disclosure.
Figure 2B:
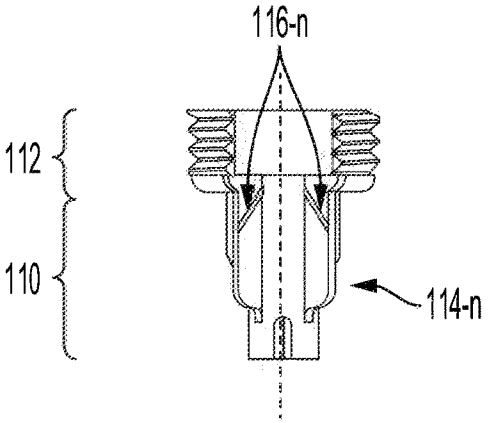
Figure 2C:
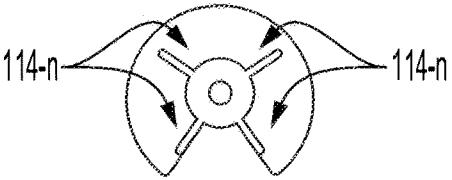
Figure 2D:
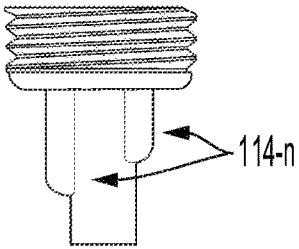

FIGS. 2A-2D are illustrations of body 104, according to some embodiments of the present disclosure. FIG. 2A shows a top view of body 104. FIG. 2B shows a front view of body 104. FIG. 2C shows a bottom view of body 104. FIG. 2D shows a side view of body 104.

Referring to FIG. 2C, lower portion 110 can include a hollow region. For example, lower portion 110 can have a cylindrical shape with a hollowed central region, which is also referred to herein as "a first opening of body 104." The first opening of body 104 can have a three-dimensional geometric shape that is the same or different from the shape of lower portion 110. For example, the shape of lower portion 110 and the first opening of body 104 can both be cylindrical.

Referring to FIG. 2A, the first opening of body 104 can have a diameter D1. In some embodiments, diameter D1 can be between 4.5 millimeters and 1.1 centimeters. In some embodiments, the diameter can vary in the first opening of body 104. For example, at one end of the first opening of body 104, the diameter can be between 4.5 millimeters and 6.5 millimeters (e.g., 6 millimeters), and at the other end of the first opening of body 104, the diameter can be between 9 millimeters and 1.1 centimeters (e.g., 1 centimeter).

Referring to FIG. 2B, lower portion 110 can be made of a metal, a plastic, a rubber, or a composite material and can include a locking mechanism. In some embodiments, the locking mechanism can be compatible with a Borden coupler, a Midwest coupler, a 6-pin coupler, or any other suitable types of coupler. The locking mechanism can be positioned at a bottom portion of lower portion 110. The locking mechanism can attach body 104 to power source 102.

Lower portion 110 can be fixed to upper portion 112. In some embodiments, lower portion 110 can be fixed to upper portion 112 along the centerline of the first opening of body 104.

Referring to FIG. 1, upper portion 112 can be made of a metal, a plastic, a rubber, or a composite material. Upper portion 112 can include a hollow region. Upper portion 112 has a sidewall surface and a bottom surface. For example, upper portion 112 can be a cylinder with portions of a sidewall, a bottom surface, and a hollowed central region. Portions of upper portion 112's sidewall is referred also to as a "sidewall of upper portion 112."

Referring to FIG. 2A, the sidewall of upper portion 112 can have a diameter D2, which represents a diameter of an inner surface of the sidewall of upper portion 112. Diameter D2 can be greater than diameter D1. For example, diameter D2 can be between 2 centimeters and 4 centimeters (e.g., 2.6 centimeters). Further, the sidewall of upper portion 112 can have another diameter D3, which represents a diameter of an outer surface of the sidewall of upper portion 112. Diameter D3 can be greater than diameter D2. For example, diameter D3 can be between 2.6 centimeters and 4.6 centimeters (e.g., 3.2 centimeters).

The sidewall of upper portion 112 and the bottom surface of upper portion 112 can form a second opening in body 104—also referred to herein as "a second opening of body 104." The second opening of body 104 can include an opening on the bottom surface, an opening on the first sidewall corresponding to the shape of the bottom surface's opening, and an opening opposite to the bottom surface. For example, the shape of the opening can be a trapezoid. The hollowed central region of upper portion 112 can include the second opening of body 104 and an end of the first opening of body 104.

Referring to FIG. 2B, an outer surface of the sidewall of upper portion 112 can include threads. The threads can be used to attach body 104 to cap 108, which is described below.

Body 104 can include one or more protrusions 114-*n*, which can allow a user to grasp body 104, for example, with its thumb and remaining fingers in an arrangement of proper hand fulcrum. One or more protrusions 114-*n* can be made of a metal, a plastic, a rubber, or a composite material. One or more protrusions 114-*n* can be a three-dimensional geometric shape, such as a rectangle. One or more protrusions 114-*n* can extend from lower portion 110. For example, one or more protrusions 114-*n* can extend from and be fixed to lower portion 110 by its longer edge. One or more protrusions 114-*n* can be fixed to the bottom surface of upper portion 112. For example, one or more protrusions 114-*n* can be fixed to the bottom surface of upper portion 112 by its shorter edge.

One or more protrusions 114-*n* can be two protrusions bordering the second opening of body 104. For example, the two protrusions can border the legs of a trapezoidal opening (e.g., the non-parallel sides of the trapezoidal opening). One or more protrusions 114-*n* can be two protrusions positioned on lower portion 110. For example, the two protrusions can be positioned equidistant from one another on lower portion 110. One or more protrusions 114-*n* can be two protrusions bordering the second opening of body 104 and two protrusions positioned on lower portion 110. For example, two protrusions can border the legs of a trapezoidal opening of body 104 and two protrusions can be positioned on lower portion 110 equidistant from the other protrusions.

One or more guides 116-*n* can align an instrument at a predetermined angle for sharpening. One or more guides 116-*n* can be part of or can be fixed to one or more protrusions 114-*n*. One or more guides 116-*n* can be positioned on one or more surfaces of one or more protrusions 114-*n* that face the geometric shape opening of the second opening of body 104. One or more guides 116-*n* can be positioned at various angles below the bottom surface of upper portion 112, relative to the centerline of the opening of body 104. For example, one or more guides 116-*n* can be positioned at about a 45-degree angle below a bottom surface of upper portion 112, relative to a centerline of the first opening of body 104. One or more guides 116-*n* can be made of a metal, a plastic, a rubber, or a composite material.

Figure 3B:
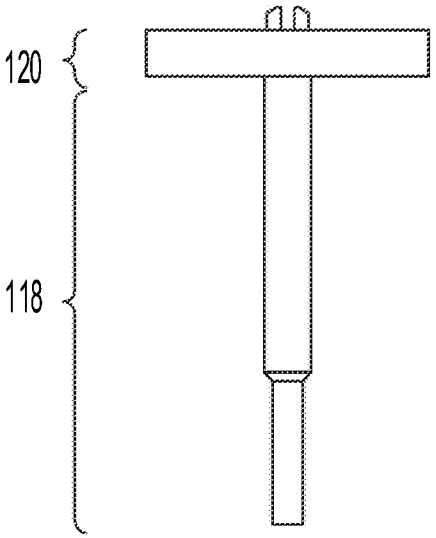
FIGS. 3A-3B are illustrations of a sharpening accessory's sharpening device for a sharpening tool, according to some embodiments of the present disclosure.
Figure 3A:
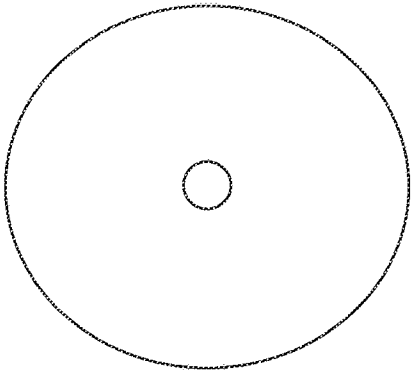

Referring to FIG. 1, sharpening device 106 can include rod 118 and top portion 120. FIGS. 3A and 3B are illustrations of sharpening device 106, according to some embodiments of the present disclosure. FIG. 3A shows a top view of sharpening device 106, and FIG. 3B shows a side view of sharpening device 106.

Rod 118 can have a three-dimensional geometric shape. Rod 118 can be the same or different three-dimensional geometric shape from top portion 120. Rod 118 can have a dimension smaller than a dimension of top portion 120. For example, rod 118 can be a cylinder with a diameter small than a diameter of top portion 120. Rod 118 can have a first end and a second end. Rod 118 can be inserted into body 104. The first end of rod 118 can be inserted into body 104 through the first opening of body 104. Top portion 120 can be connected to the second end of rod 118. Top portion 120 can be connected to the second end of rod 118 so that top portion 120 is positioned towards the second opening of body 104; for example, between the bottom surface of upper portion 112 and a top surface of cap 108. Top portion 120 can be connected to the second end of rod 118 via a screw or another fastening mechanism. Rod 118 can be made of a metal, a plastic, a rubber, or a composite material.

Top portion 120 can be a sharpening stone, according to some embodiments. Top portion 120 can be a three-dimensional geometric shape. For example, top portion 120 can be a cylinder. Top portion 120 can include an abrasive material, such as an aluminum oxide, a silicon carbide, a novaculite, or any other suitable abrasive material.

Figure 4A:
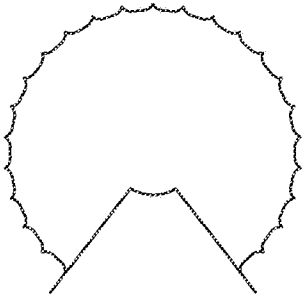
FIGS. 4A-4D are illustrations of a sharpening accessory's cap for a sharpening tool, according to some embodiments of the present disclosure.
Figure 4B:
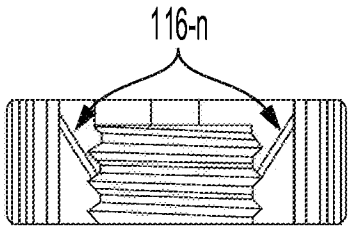
Figure 4C:
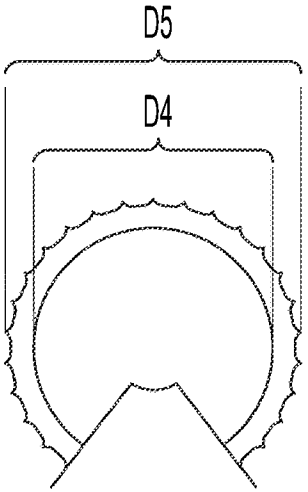
Figure 4D:
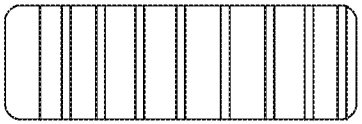

Referring to FIG. 1, cap 108 can be removable, according to some embodiments. FIGS. 4A-4D are illustrations of cap 108, according to some embodiments of the present disclosure. FIG. 4A shows a top view of cap 108. FIG. 4B shows a front view of cap 108. FIG. 4C shows a bottom view of cap 108. FIG. 4D shows a side view of cap 108. Cap 108 can include one or more guides 116-*n*. FIGS. 4A-4D can be understood with reference to FIG. 1.

Cap 108 can be a hollowed three-dimensional geometric shape. In some embodiments, cap 108 can have a sidewall surface and a top surface. For example, cap 108 can be a cylinder with a sidewall surface and a top surface. Referring to FIG. 4C, portions of a sidewall can be considered portions of a second sidewall, in which portions of the second sidewall can have a diameter D4, which can represent an inner surface of portions of the second sidewall. The inner surface of portions of the second sidewall can have the same diameter D4 as diameter D3, an outer surface of portions of the first sidewall of upper portion 112. For example, diameter D4 can be between 2.6 centimeters and 4.6 centimeters (e.g., 3.2 centimeters).

Portions of the second sidewall can have a second diameter D5, which represents a diameter of an outer surface of portions of the second sidewall. Diameter D5 can be greater than diameter D4. For example, diameter D5 can be between 3.2 centimeters and 5.2 centimeters (e.g., 3.7 centimeters). An outer surface of portions of the second sidewall can include a texture. The texture can allow a user to grip cap 108. For example, an outer surface of portions of a second sidewall can include a ribbed texture.

Portions of the second sidewall and the top surface can form a third opening. The third opening can include a geometric shape opening on the top surface, an opening on the second sidewall corresponding to the geometric shape opening on the top surface, and an opening opposite to the top surface. For example, the geometric shape opening can be a trapezoid. The third opening can correspond to the second opening of body 104. For example, the trapezoidal opening of the third opening of cap 108 can align with the trapezoidal opening of the second opening of body 104.

The inner surface of portions of the second sidewall can include threads that attach cap 108 to body 104 via threads on the outer surface of portions of the first sidewall of upper portion 112, according to some embodiments.

Referring to FIG. 4B, portions of the second sidewall can include one or more guides 116-*n*. One or more guides 116-*n* align an instrument at a predetermined angle for sharpening. One or more guides 116-*n* can be part of or can be fixed to portions of the second sidewall. One or more guides 116-*n* can be positioned on one or more surfaces of portions of the second sidewall that face the geometric shape opening of the third opening of cap 108. One or more guides 116-*n* can be positioned at various angles above the bottom surface of upper portion 112, relative to the centerline of the first opening of body 104. For example, one or more guides 116-*n* can be positioned at about a 45-degree angle above a bottom surface of upper portion 112, relative to a centerline of a first opening of body 104. Cap 108 can be made of a metal, a plastic, a rubber, or a composite material.

FIGS. 5A-5E are illustrations of a sharpening accessory's body 104, sharpening device 106, and cap 108, for a sharpening tool, according to some embodiments of the present disclosure. FIG. 5A shows a top view of body 104 and sharpening device 106. FIG. 5B shows a top view of sharpening device 106 and cap 108. FIG. 5C shows a front view of body 104, sharpening device 106, and cap 108. FIG. 5D shows a bottom view of body 104, sharpening device 106, and cap 108. FIG. 5E shows a side view of body 104, sharpening device 106, and cap 108. As discussed, above, body 104 can include lower portion 110, upper portion 112, one or more protrusions 114-*n*, and one or more guides 116-*n*. Sharpening device 106 can include rod 118 and top portion 120. Cap 108 can include one or more guides 116-*n*.

It is to be appreciated that the Detailed Description section, and not any other section, is intended to be used to interpret the claims. Other sections can set forth one or more but not all exemplary embodiments as contemplated by the inventor, and thus, are not intended to limit this disclosure or the appended claims in any way.

The foregoing disclosure outlines features of several embodiments so that those skilled in the art can better understand the aspects of the present disclosure. Those skilled in the art will appreciate that they can readily use the present disclosure as a basis for designing or modifying other processes and structures for carrying out the same purposes and/or achieving the same advantages of the embodiments introduced herein. Those skilled in the art will also realize that such equivalent constructions do not depart from the spirit and scope of the present disclosure, and that they can make various changes, substitutions, and alterations herein without departing from the spirit and scope of the present disclosure.

References herein to "one embodiment," "an embodiment," "an example embodiment," or similar phrases, indicate that the embodiment described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it would be within the knowledge of persons skilled in the relevant art(s) to incorporate such feature, structure, or characteristic into other embodiments whether or not explicitly mentioned or described herein.

The breadth and scope of this disclosure should not be limited by any of the above-described exemplary embodiments, but should be defined only in accordance with the following claims and their equivalents.

What is claimed is:

1. An apparatus, comprising:

a body with a lower portion and an upper portion, wherein:

a diameter of the lower portion is less than a diameter of the upper portion;

a central region of the lower portion comprises a first opening; and portions of a first sidewall and a bottom surface of the upper portion comprise a second opening;

one or more protrusions extending from the lower portion of the body and attached to the bottom surface of the upper portion of the body; and a cap configured to be attached to the upper portion of the body, wherein the cap comprises portions of a second sidewall and a top surface with a third opening configured to align with the second opening;

wherein the one or more protrusions comprise one or more first guides positioned below the bottom surface of the upper portion of the body; and wherein the portions of the second sidewall comprise one or more second guides positioned above the bottom surface of the upper portion of the body.

2. The apparatus of claim 1, wherein the lower portion of the body comprises a locking mechanism.

3. The apparatus of claim 1, wherein the one or more protrusions comprise two protrusions bordering the second opening of the body and two protrusions positioned on the lower portion of the body.

4. The apparatus of claim 1, wherein the one or more first guides are positioned at a forty-five degree angle below the bottom surface of the upper portion of the body.

5. The apparatus of claim 1, wherein the one or more second guides are positioned at a forty-five degree angle above the bottom surface of the upper portion of the body.

6. The apparatus of claim 1, wherein the cap comprises threads configured to attach the cap to the upper portion of the body.

7. The apparatus of claim 1, wherein the portions of the second sidewall comprise a ribbed outer wall.

8. An apparatus, comprising:

a body with a lower portion and an upper portion, wherein:

a diameter of the lower portion is less than a diameter of the upper portion;

a central region of the lower portion comprises a first opening; and portions of a first sidewall and a bottom surface of the upper portion comprise a second opening;

one or more protrusions extending from the lower portion of the body and attached to the bottom surface of the upper portion of the body;

a sharpening device, comprising:

a top portion with an abrasive material; and a rod connected to the top portion and configured to be inserted into the first opening of the body; and a cap configured to be attached to the upper portion of the body, wherein the cap comprises portions of a second sidewall and a top surface with a third opening configured to align with the second opening;

wherein the one or more protrusions comprise one or more first guides positioned below the bottom surface of the upper portion of the body; and wherein the portions of the second sidewall comprise one or more second guides positioned above the bottom surface of the upper portion of the body.

9. The apparatus of claim 8, wherein the lower portion of the body comprises a locking mechanism.

10. The apparatus of claim 8, wherein the one or more protrusions comprise two protrusions bordering the second opening of the body and two protrusions positioned on the lower portion of the body.

11. The apparatus of claim 8, wherein the one or more first guides are positioned at a forty-five degree angle below the bottom surface of the upper portion of the body.

12. The apparatus of claim 8, wherein the one or more second guides are positioned at a forty-five degree angle above the bottom surface of the upper portion of the body.

13. The apparatus of claim 8, wherein the cap comprises threads configured to attach the cap to the upper portion of the body.

14. The apparatus of claim 8, wherein the portions of the second sidewall comprise a ribbed outer wall.

15. A system, comprising:

a sharpening accessory, comprising:

a body with a lower portion and an upper portion, wherein:

a diameter of the lower portion is less than a diameter of the upper portion;

a central region of the lower portion comprises a first opening;

portions of a first sidewall and a bottom surface of the upper portion comprise a second opening; and portions of the first sidewall comprise a threaded outer surface;

one or more protrusions extending from the lower portion of the body and attached to the bottom surface of the upper portion of the body;

a removable cap, wherein:

portions of a second sidewall and a top surface comprise a third opening configured to align with the second opening; and portions of the second sidewall comprise a threaded inner surface configured to attach to the threaded outer surface of the body; and a sharpening device, comprising:

a rod with a first end and a second end, wherein the first end is configured to be inserted through the first opening of the body; and a sharpening stone connected to the second end of the rod, wherein the sharpening stone is positioned towards the second opening of the body; and a power source connected to the first end of the rod, wherein the power source is configured to rotate the sharpening device;

wherein the one or more protrusions comprise one or more first guides positioned below the bottom surface of the upper portion of the body; and wherein the portions of the second sidewall comprise one or more second guides positioned above the bottom surface of the upper portion of the body.

16. The system of claim 15, wherein the lower portion of the sharpening accessory comprises a locking mechanism configured to attach the sharpening accessory to the power source.

17. The system of claim 15, wherein the one or more protrusions comprise two protrusions bordering the third opening of the body and two protrusions positioned on the lower portion of the body.

18. The system of claim 15, wherein the one or more first guides are positioned at a forty-five degree angle below the bottom surface of the upper portion of the body.

19. The system of claim 15, wherein the one or more second guides are positioned at a forty-five degree angle above the bottom surface of the upper portion of the body.

20. The system of claim 15, wherein the power source is pneumatic or electric.

* * * * *